US008578680B2

(12) United States Patent
Abeln et al.

(10) Patent No.: US 8,578,680 B2
(45) Date of Patent: Nov. 12, 2013

(54) TOWER CONSTRUCTION METHOD AND APPARATUS

(75) Inventors: Travis W. Abeln, Olathe, KS (US); Mark A. Muder, Olathe, KS (US)

(73) Assignee: EvapTech, Inc., Lenexa, KS (US)

( * ) Notice: Subject to any disclaimer, the term of this patent is extended or adjusted under 35 U.S.C. 154(b) by 451 days.

(21) Appl. No.: 12/895,951

(22) Filed: Oct. 1, 2010

(65) Prior Publication Data

US 2011/0078976 A1 Apr. 7, 2011

Related U.S. Application Data

(60) Provisional application No. 61/248,257, filed on Oct. 2, 2009.

(51) Int. Cl.
*E04G 21/14* (2006.01)

(52) U.S. Cl.
USPC ..... 52/745.2

(58) Field of Classification Search
USPC ..... 52/745.2, 745.03, 745.18, 651.05, 52/653.1
See application file for complete search history.

(56) References Cited

U.S. PATENT DOCUMENTS

| | | | | |
|---|---|---|---|---|
| 3,502,364 | A * | 3/1970 | Moore | 294/67.1 |
| 3,616,592 | A * | 11/1971 | Rothman | 52/705 |
| 3,672,115 | A | 6/1972 | Abe et al. | |
| 3,831,327 | A * | 8/1974 | McCrillis et al. | 52/79.1 |
| 3,870,773 | A * | 3/1975 | Luzaich | 261/111 |
| 3,982,732 | A | 9/1976 | Pender | |
| 4,045,937 | A * | 9/1977 | Stucky | 52/745.03 |
| 4,189,892 | A * | 2/1980 | Smith | 52/749.1 |
| 4,269,442 | A * | 5/1981 | Craig | 294/81.56 |
| 4,374,786 | A | 2/1983 | McClain | |
| 4,528,793 | A * | 7/1985 | Johnson | 52/745.03 |
| 4,542,928 | A * | 9/1985 | Fowler, Jr. | 294/81.1 |
| 4,769,959 | A | 9/1988 | Lindsey | |
| 5,388,376 | A | 2/1995 | Demeyer | |
| 5,716,088 | A * | 2/1998 | Chander et al. | 294/81.1 |
| 6,497,401 | B2 * | 12/2002 | Flaherty | 261/109 |
| 7,234,282 | B2 | 6/2007 | Cornell et al. | |
| 7,357,100 | B2 | 4/2008 | Waseda et al. | |
| 2003/0079436 | A1 * | 5/2003 | Manfre | 52/745.2 |

(Continued)

FOREIGN PATENT DOCUMENTS

DE 19924466 A1 11/2000

OTHER PUBLICATIONS

Int'l Search Report and Written Opinion issued Oct. 30, 2012 in Int'l Application No. PCT/US2010/051048.

*Primary Examiner* — Christine T Cajilig
(74) *Attorney, Agent, or Firm* — Panitch Schwarze Belisario & Nadel LLP

(57) ABSTRACT

A method for constructing a structure to be lifted and moved from a first location to a second location includes (a) constructing, at the first location, a framework of the structure that includes braces to withstand lifting and moving the structure; (b) constructing, at the first location, at least some internal components of the structure; (c) providing a lift platform capable of supporting, balancing and lifting the structure below the lift platform by flexible lift members attachable to the lift platform and the framework; (d) attaching the flexible lift members to the lift platform and to a plurality of spaced portions of the framework; (e) lifting the lift platform to thereby lift the structure; and (f) while lifted, moving the lift platform and the structure to the second location, where the structure is lowered. A lift platform preferably made of subassemblies of beams and braces is used in the method.

8 Claims, 13 Drawing Sheets

(56) References Cited

U.S. PATENT DOCUMENTS

2003/0188495 A1* 10/2003 Taylor et al. ..... 52/93.1
2004/0025466 A1 2/2004 Hink et al.
2007/0214742 A1* 9/2007 Long ..... 52/745.2
2008/0209849 A1* 9/2008 Baird ..... 52/745.2
2009/0028647 A1 1/2009 Bingham et al.
2009/0232623 A1* 9/2009 Munro et al. ..... 414/10

* cited by examiner

TOWER CONSTRUCTION METHOD AND APPARATUS

CROSS-REFERENCE TO RELATED APPLICATION

This application claims the benefit under 35 U.S.C. §119 (e) of U.S. Provisional Patent Application No. 61/248,257, filed Oct. 2, 2009, the disclosure of which is hereby incorporated herein by reference in its entirety.

BACKGROUND OF THE INVENTION

The present invention relates to a method for constructing a large structure, such as a heat exchange tower, and apparatus for use in such construction method.

More particularly, the present invention relates to a method for constructing a structure that, when constructed, is too large to transport using typical transportation methods such as the highways or railways. Otherwise, the structure could simply be made offsite and transported by rail or truck to the desired location whenever it is needed. There are many typical structures that are field-erected because they are too large to transport by highways or railways. Examples of such structures include heat exchange apparatus, and by way of further example cooling towers and the like, water treatment structures, large water or other liquid or gas storage structures, industrial, commercial or residential buildings, especially those constructed from subassemblies or modules, and any number and type of other large structures. These structures are typically constructed in the place where they are needed to operate and function.

Such structures are often used to replace similar existing structures in locations such as power plants, water treatment plants, refineries, hospitals, or other industrial or commercial operations. When the structure is replacing an existing structure, or is otherwise being incorporated into an existing system containing other components, it is critical to minimize downtime during initial and replacement construction of structures associated with the ongoing operations. Thus, for example, at a power plant, if heat exchange apparatus, such as a cooling tower, were not able to be replaced quickly, substantially the entire power plant would have to be shut down and either critical services provided by the power plant would not be available or such services would have to be provided by other operators elsewhere. While sometimes portable equipment can be used temporarily to sustain some level of operation, typically on a reduced scale, the lost time and associated revenue involved with the construction clearly must be minimized.

The present invention reduces such downtime significantly and allows for construction in a nearby, preferably adjacent, site of the structure to be built while a site is being readied or to allow time to dismantle and remove an original structure to be replaced. In this way, construction of the new structure can occur at the same time as the old structure is being dismantled, and when the desired site is available, the new structure can be readily moved to the site, final construction details taken care of and the industrial or commercial operation requiring the use of the structure can begin promptly.

The present invention also involves apparatus in the form of a lift platform that may be used with the method of construction according to the present invention. The lift platform, preferably made of subassemblies as described below, may be lifted by a movable hoist, such as a crane, or even an aircraft such as a helicopter, connected to the structure to be moved from a first location where the structure is being constructed to a second location, which is the ultimate, desired location. The lift platform is sufficiently strong and balanced to be able to lift the structure and move it without damage, including damage either to its framework or to any of the internal components of the structure that are being assembled within the structure at the first location so that there is less work to be done in finishing the construction of the structure at the second site.

As used herein, the singular forms "a", "an", and "the" include plural referents, and plural forms include the singular referent unless the context clearly dictates otherwise.

As used herein, the term "field-erected" with respect to the type of structure to be constructed, lifted and moved according to the present invention means a structure of any type that is too large to be moved using rail or highway transportation due to the size of the structure exceeding the limits imposed for rail or highway transportation.

Certain terminology is used in the following description for convenience only and is not limiting. Words designating direction such as "bottom," "top," "front," "back," "left," "right" and "sides" designate directions in the drawings to which reference is made, but are not limiting with respect to the orientation in which the invention and its components and apparatus may be used. The terminology includes the words specifically mentioned above, derivatives thereof and words of similar import.

As used herein, the term "generally" or derivatives thereof with respect to any element or component means that the element or component has the basic shape, direction, orientation or the like to the extent that the function of the element or component would not be materially adversely affected by somewhat of a change in the element or component. By way of example and not limitation, where generally perpendicular braces are oriented generally perpendicularly between and connected at opposite ends to transverse lift beams, the braces can be oriented a few degrees more or less than exactly 90° with respect to the beams such that the braces and beams still would be "generally perpendicular" with respect to each other, where such variations do not materially adversely affect the function of the element, component of the subassembly or assembly of which the element or component is a part or with which it is used.

As used herein, the term "ground-based," with respect to a description of a movable hoist, means that the hoist is directly connected or indirectly connected to the ground, as by an intermediate connection to a portion of a support or building or to a vehicle like a mobile crane supported by the ground, to a vessel supported by water or to an underwater structure. This is as opposed to a hoist that is connected to some type of aircraft, such as a helicopter, that during lifting has no direct or indirect connection to the ground. The movable hoist is "movable" by virtue of the hoist having the ability to lift and move the structure from a first location to a second location, even if it is just by lifting and swiveling from a fixed base position, as well as also by traversing across the ground or water.

As used herein, the term "horizontal," derivatives thereof and words of similar import, with respect to the orientation of an element or component of any element relating to the present invention, means the generally horizontal direction or orientation, that is generally, but not necessarily absolutely parallel to the ground, or not necessarily absolutely perpendicular to a vertical or upright direction, when the element or component is erected as a part of an assembly or subassembly of a structure, rather than in an unerected or unassembled state or condition.

As used herein, the term "vertical," derivatives thereof and words of similar import, with respect to the orientation of an element or component of any element relating to the present invention, means the generally vertical or upright direction or orientation, that is generally, but not necessarily absolutely perpendicular to the ground, when the element or component is erected as a part of an assembly or subassembly of a structure, rather than in an unerected or unassembled state or condition.

BRIEF SUMMARY OF THE INVENTION

One aspect of the present invention relates to a method for constructing a field-erected structure, wherein the structure is to be lifted and moved from a first location to a second location, the method comprising:

(a) constructing, at the first location, a framework of the structure, the framework including braces as necessary to withstand lifting and moving the structure;

(b) constructing, at the first location, at least some internal components of the structure within the framework;

(c) providing a lift platform comprising interconnected longitudinal and transverse beams, wherein the lift platform is capable of supporting, balancing and lifting the framework below the lift platform by flexible lift members to be attached to the lift platform and the framework;

(d) attaching the flexible lift members to the lift platform and to a plurality of spaced portions of the framework to balance the structure below the lift platform;

(e) lifting the lift platform to thereby lift the structure; and (f) while lifted, moving the lift platform and the structure to the second location.

Another aspect of the present invention relates to a lift platform adapted for lifting and moving a structure to be lifted, the platform comprising at least two transversely spaced longitudinal carrier beams supporting on their upper surfaces a plurality of longitudinally spaced transverse lift beams, the longitudinal carrier beams being connected to the transverse lift beams where the longitudinal carrier beams intersect with the transverse beams, the lift platform further comprising a plurality of braces oriented between and connected to pairs of the transverse lift beams, at least two platform lift lugs being connected to the longitudinal carrier beams, the platform lift lugs being spaced to support and balance the longitudinal carrier beams and therefore the transverse lift beams and braces and any structure which the lift platform is to lift, at least some of the transverse lift beams having structure lift lugs connected to the transverse lift beams, the structure lift lugs being spaced to support and balance the structure to be lifted.

The present invention overcomes the often critical time constraints faced when it is necessary to construct a structure at a particular location where the location is not ready to receive the structure, such that the structure can be constructed, at least in part, and preferably in a significant portion, preferably on available adjacent space, while the location is being readied to receive the structure or while an original structure at the desired location that is to be replaced is being dismantled.

Although the present invention relates to the construction of any field-erected structure, such as those mentioned above, among others, the present invention will be described more particularly and without limitation with reference to the construction of a cooling tower to be used with any type of commercial or industrial operation, such as, but not exclusively, power plants.

BRIEF DESCRIPTION OF THE SEVERAL VIEWS OF THE DRAWINGS

The foregoing summary, as well as the following detailed description of the preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

DETAILED DESCRIPTION OF THE PREFERRED EMBODIMENTS

Figure 1:
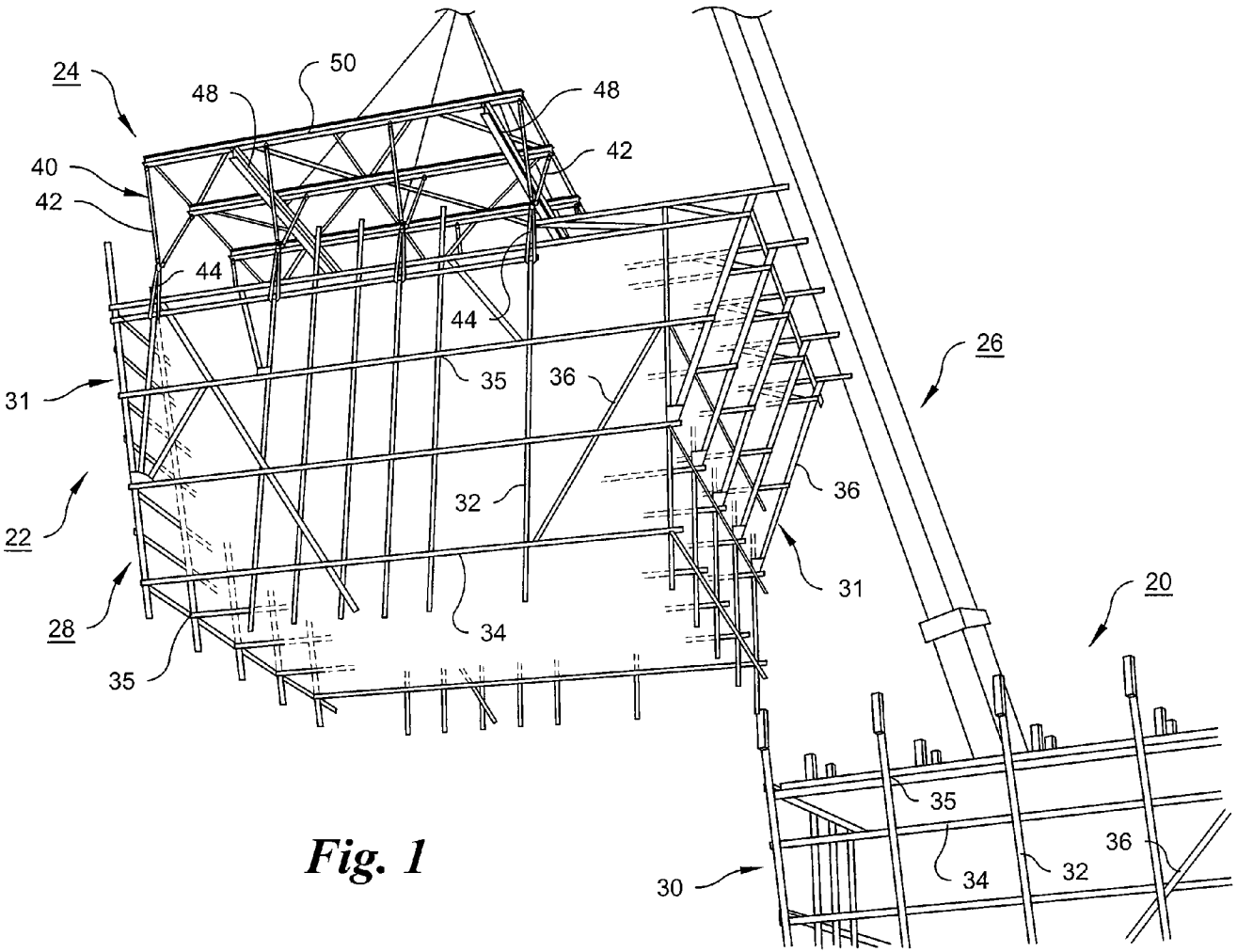
FIG. 1 is a depiction in a right, lower side isometric view of a top portion of one embodiment of a structure, namely, an evaporative heat exchange apparatus in the form of a field-erected cooling tower, where the structure is in the process of being moved by a hoist from a first location to a second location, according to the method of the present invention using a lift platform according to the present invention.
Figure 2:
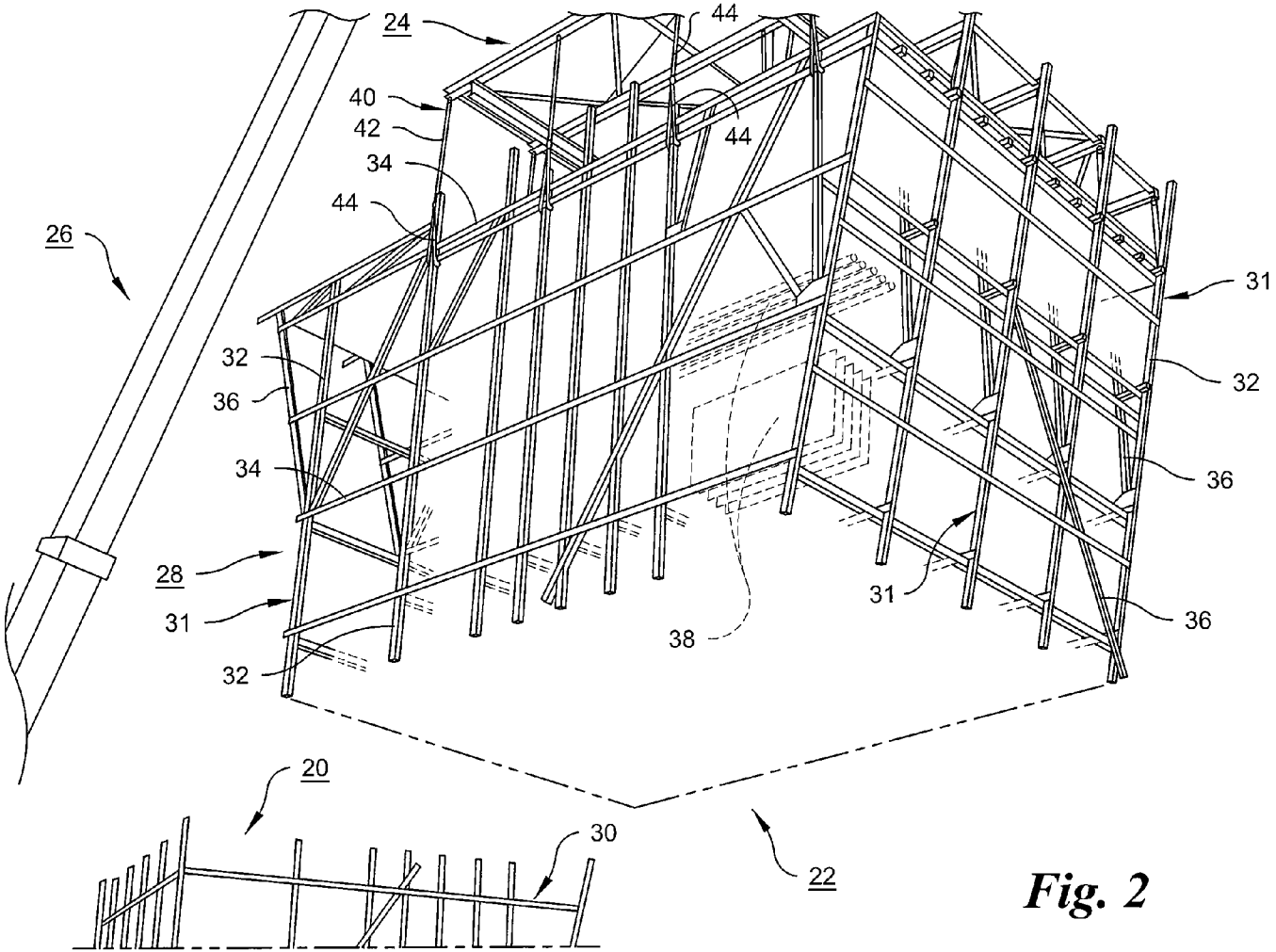
FIG. 2 shows the left and front sides of the top portion of the cooling tower from a lower isometric viewpoint.
Figure 5:
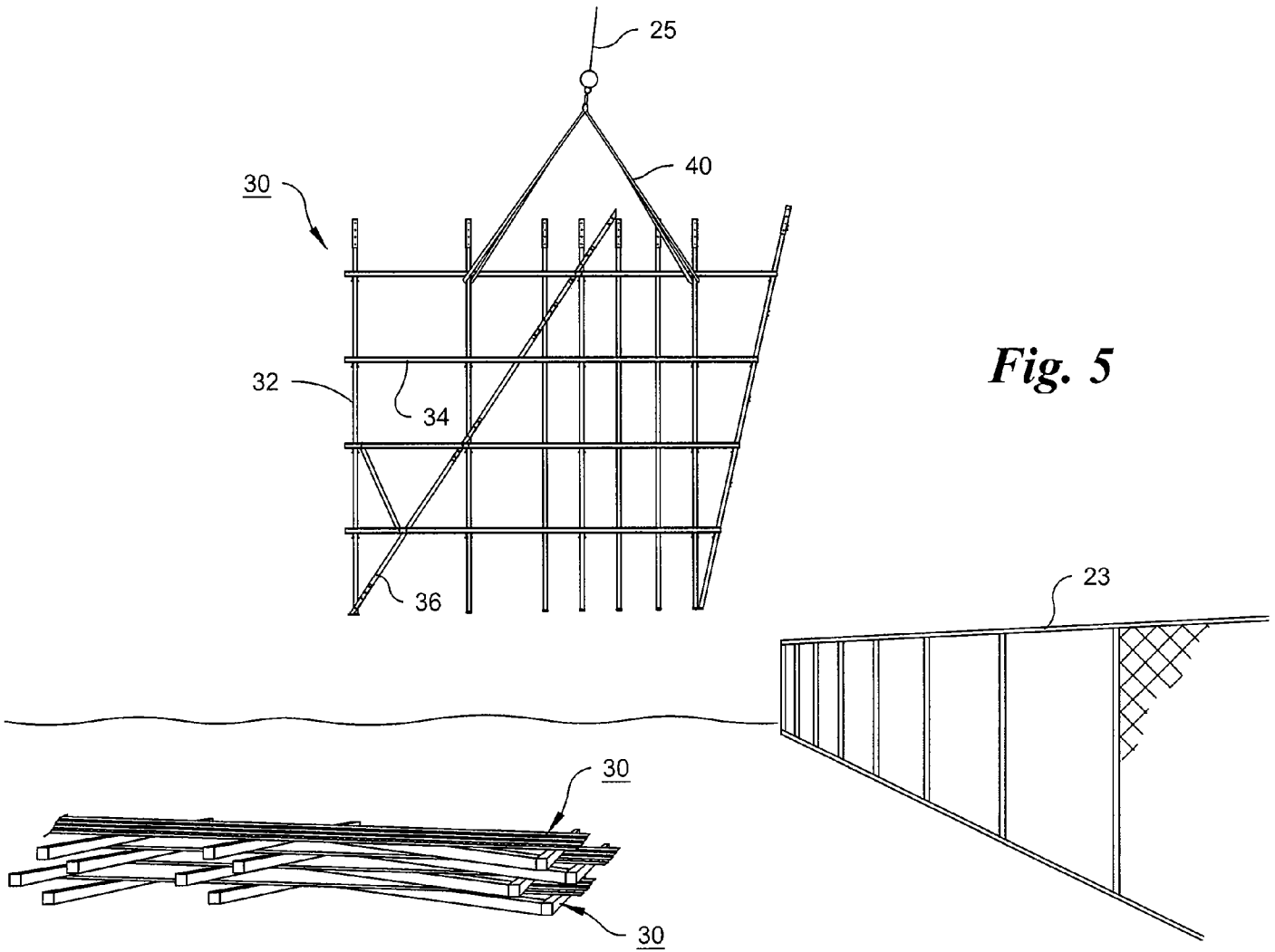
FIG. 5 depicts the initial lifting of one of the bents of FIG. 3 from among a group of such bents to construct, at a first location, the bottom portion of the cooling tower shown in FIG. 1, while a site at a second location is being readied for moving the bottom portion of the cooling tower from the first location to the second location.
Figure 7:
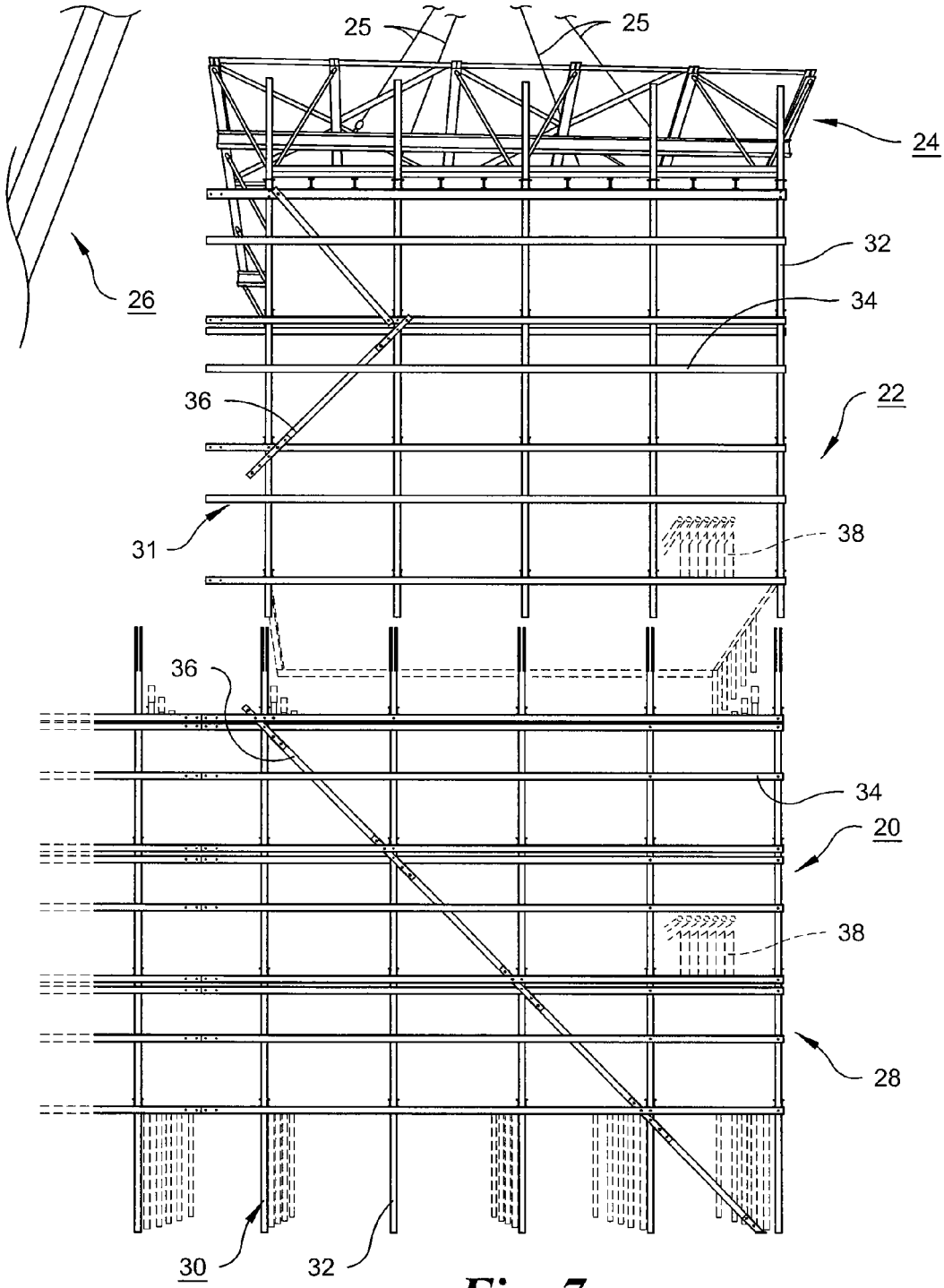
FIG. 7 is a front elevation view of a cooling tower structure in which the top portion of the structure is about to be lowered onto and connected with the bottom portion of the structure at the second, desired location.

With reference to the drawings, where like elements are identified by like numerals throughout the several views, and initially with particular reference to FIGS. 1, 2 and 7, the method of the present invention is described with respect to one presently preferred embodiment of a cooling tower, as an example, without limitation, of a field-erected structure to be constructed partially at a first location and then moved to a second location, where the final construction is completed. The construction at the first location can be ongoing while the site at the second location is being readied or while a prior cooling tower at the second location is being dismantled and removed, so as to reduce the time needed to construct the cooling tower. The time reduction is the time it takes to prepare the site at the second location or to dismantle and remove any existing structure being replaced at the second location. As shown in FIGS. 1, 2 and 7, the cooling tower includes a bottom, base or lower portion 20, shown already in the desired second location in the right-hand side of FIG. 1 and the left-hand side of FIG. 2, and a top or upper portion 22 that is being moved to be placed on top of the bottom portion, best seen in FIG. 7. FIG. 5 shows the beginning of the construction of the lower portion 20 at a first location by the initial lifting of one of the members used to form the lower portion, as described below, while a site at a second location is being readied for moving the bottom portion of the cooling tower from the first location to the second location. Thus, the method of the present invention includes the construction of a portion of a multi-portion structure where the portion that is constructed at the first location and then moved to the second location according to the invention would have been field-erected directly at the second location, prior to the present invention.

For purposes of illustration, the cooling tower top portion 22 is shown in FIGS. 1, 2 and 7 as being lifted using one embodiment of a lift platform 24 according to a second aspect of the present invention, by a movable hoist, such as a ground-based lifting device, for instance a fixed or mobile crane 26. Using the lift platform 24, only one movable hoist is needed to lift and move the structure from a first location to a second location. If desired, and if longer distances were involved, the lift platform 24, and therefore, the structure, could be lifted by a helicopter (not shown) having a suitable lift capacity.

Figure 3:
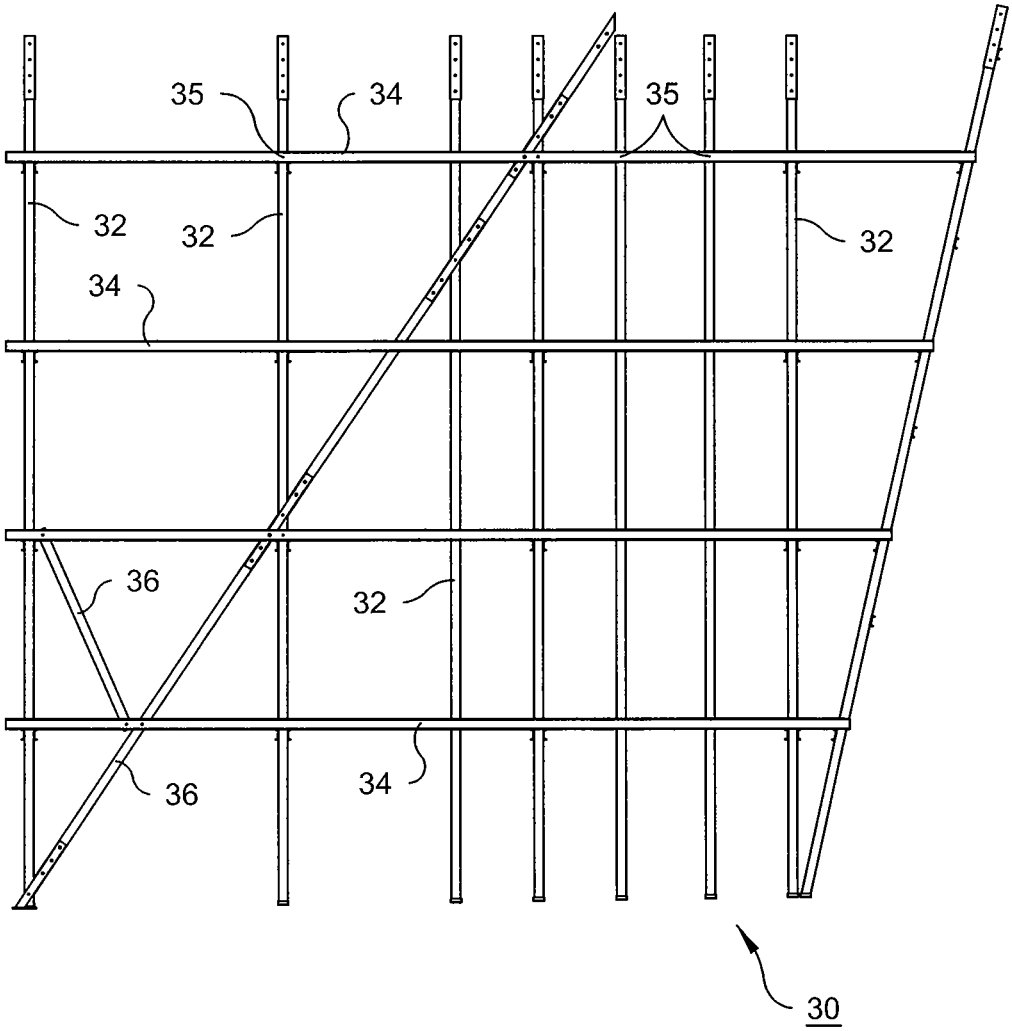
FIG. 3 is a side elevation view of a schematic representation of a first subassembly called a "bent" used to construct a bottom portion of a cooling tower according to the present invention.
Figure 4:
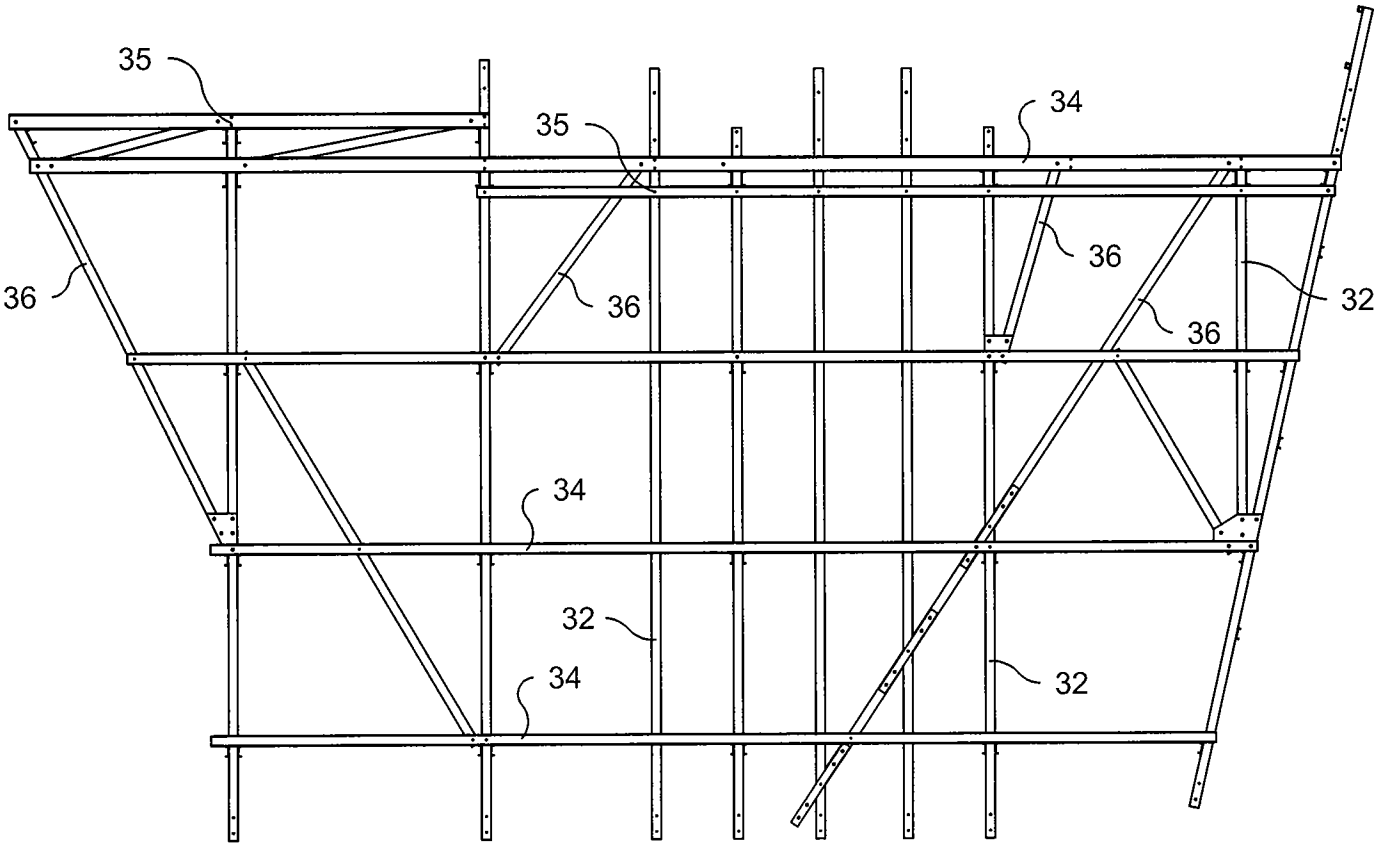
FIG. 4 is a side elevation view of a schematic representation of a bent used to construct a top portion of a cooling tower according to the present invention.

Each of the bottom portion 20 and the top portion 22 includes a framework 28 of a type normally used in a field-erected cooling tower, where, prior to the present invention, the cooling tower would have been erected directly in the desired location, such as at a site at the second location. Typically such sites contain a cooling tower being dismantled and replaced by the cooling tower being constructed in and moved from the first location to the second location. In the present invention, the framework 28 is formed by erecting and connecting together subassemblies called "bents" in the cooling tower industry, where typical bents are shown by the schematic representations shown in FIGS. 3 and 4. FIG. 3 shows a typical bent subassembly 30 used to form the framework 28 of a bottom portion 20 of a cooling tower. FIG. 4 shows a typical bent subassembly 31 used to form the framework 28 of a top portion 22 of a cooling tower.

With reference to FIGS. 1-7, the bents 30 and 31 include vertical members 32 and horizontal members 34 that meet at intersections 35. Depending on the nature of the structure and the materials used to make the structure to be lifted, several strategically located diagonal braces 36 are used to brace the framework 28 as necessary to support the structure so that the structure can withstand lifting and moving. Typically, the diagonal braces 36 are located so as not to adversely affect the function or the operation of the structure when in use, and therefore, may be left in place. However in some instances, it may be necessary to remove some of the braces 36 when the structure has been moved from the first location to the second location.

FIG. 5 shows the initial lifting of a bent 30 to begin to form the framework of a structure, such as the bottom portion 20 of a cooling tower being constructed at a first location, such as on the left side of a fence 23, to be lifted and moved to a desired second location, preferably adjacent the first location, such as on the right side of the fence 23. At the second location on the right side of the fence, an existing cooling tower (not shown) may be in the process of being dismantled or already had been removed during the construction of sections or portions of the new cooling tower, such as the bottom portion 20, or the top portion 22, at the first location on the left side of the fence 23. When the structure being built at the first location on the left side of the fence is completed and when the site at second location on the right side of the fence is ready, the bottom portion 20 is moved from the first location to the second location. When or while the bottom portion 20 that already had been constructed at the first location and moved to the second location is in place at the second location, other portions of the structure, such as the top portion 22, may be simultaneously built at the first location to be moved when done to be placed on top of the bottom portion at the second location. Although a fence 23 is used only for purpose of illustrating or denoting a boundary between the first and second locations, of course the first and second locations need not be on opposite sides of a fence 23 or any other specific device for demarking or denoting the boundaries of the first and second locations.

As shown in FIG. 5, the vertical members 32 and the horizontal members 34 forming the bent 30 typically are made of a tubular fiberglass-reinforced polymer, hot-dipped galvanized steel, stainless steel or the like, where the tubes preferably have a square cross-section, though tubes of other shapes and materials may be used. Moreover, the horizontal members 34, like the vertical members 32, may be made of other shapes besides tubes, and may be made of other materials, if desired. The braces 36 and other connecting components used to connect the bents 30 to form the framework 28 are made of conventional materials well known to those skilled in the art. The particular materials, shapes and even types of components, as well as types of structures are less important to the method than the construction method itself according to the present invention. In constructing a structure at the first location, the framework 28 is made, for example, by using bents 30 (or bents 31, not shown in FIG. 5), and then by raising the bents to desired positions and then connecting the bents 30 or 31 together using struts, braces, gusset plates or other typical components, that are typically connected by fastening them using bolts and nuts, rivets, welding or the like.

Once the framework 28 has been constructed, it is preferred that as many internal components 38 be included and constructed at the first location as is practical so as to take advantage of the time that the site at the second location is being prepared. Such internal components 38 for a cooling tower typically include heat transfer media, drift eliminators, coil assemblies, piping, pumps, spray manifolds and nozzles, decking, etc. Some of the internal components are connectable to external components (not shown), such as water sources or drains, process fluid sources and receivers, as necessary for the use and operation of the cooling tower or other structure. Other external or exterior components, such as panels, louvers, fans, etc. (not shown) may be added to the structure later at the second location. A goal of the construction method of the present invention is to construct as much of the structure as possible at the first location so that as complete a structure as possible can be built while the second location is being made available. By doing so, the structure may be completed and made operable as soon as possible after the structure is lifted and moved to the second location. It is preferable that the first location be as near as possible to the second location to minimize travel time and cost and to reduce any likelihood of problems developing during the move. Ideally, the first location should be as close as possible to the second location to allow for efficient movement of the structure from the first location to the second location with no or at least minimal damage resulting from lifting and moving field-erected structures, yet sufficiently far from the second location that activity occurring at one location does not adversely affect activity at the other location. The first location encompasses even a nearby third or more locations, as the first location may be considered to be any location or locations other than the second location, where the various sections, portions or subassemblies of the ultimately desired structure may be constructed in advance to being lifted and moved to the second location.

After construction of the structure such as a heat exchange apparatus, for example a cooling tower, which may be constructed in portions, such as a bottom portion 20 or top portion 22, takes place at the first location with as many internal components 38 as time allows to be installed, the structure is then attached to a suitable device for lifting the structure and moved to the second location.

The construction method of the present invention need not use any particular equipment to lift and move the structure from the first location to the second location. However, the method is efficiently and effectively carried out in part using a lift device like a crane 26 or helicopter connected by cables, such as four cables 25 (best seen in FIGS. 1, 7 and 8), to a lift platform 24 that is capable of supporting, balancing and lifting the structure by flexible lift members 40 to be attached to the lift platform 24 and the framework 28 of the structure beneath the lift platform 24 to be lifted and moved. The cables 25 should be evenly arranged, oriented and spaced to assure appropriate weight distribution and balance, as well as strength, to lift both the lift platform 24 and the structure, such as the cooling tower bottom portion 20 and top portion 22. The cables 25 are of any suitable type and material to support the load of the lift platform and the structure to be lifted, and many types are readily available commercially.

Figure 6:
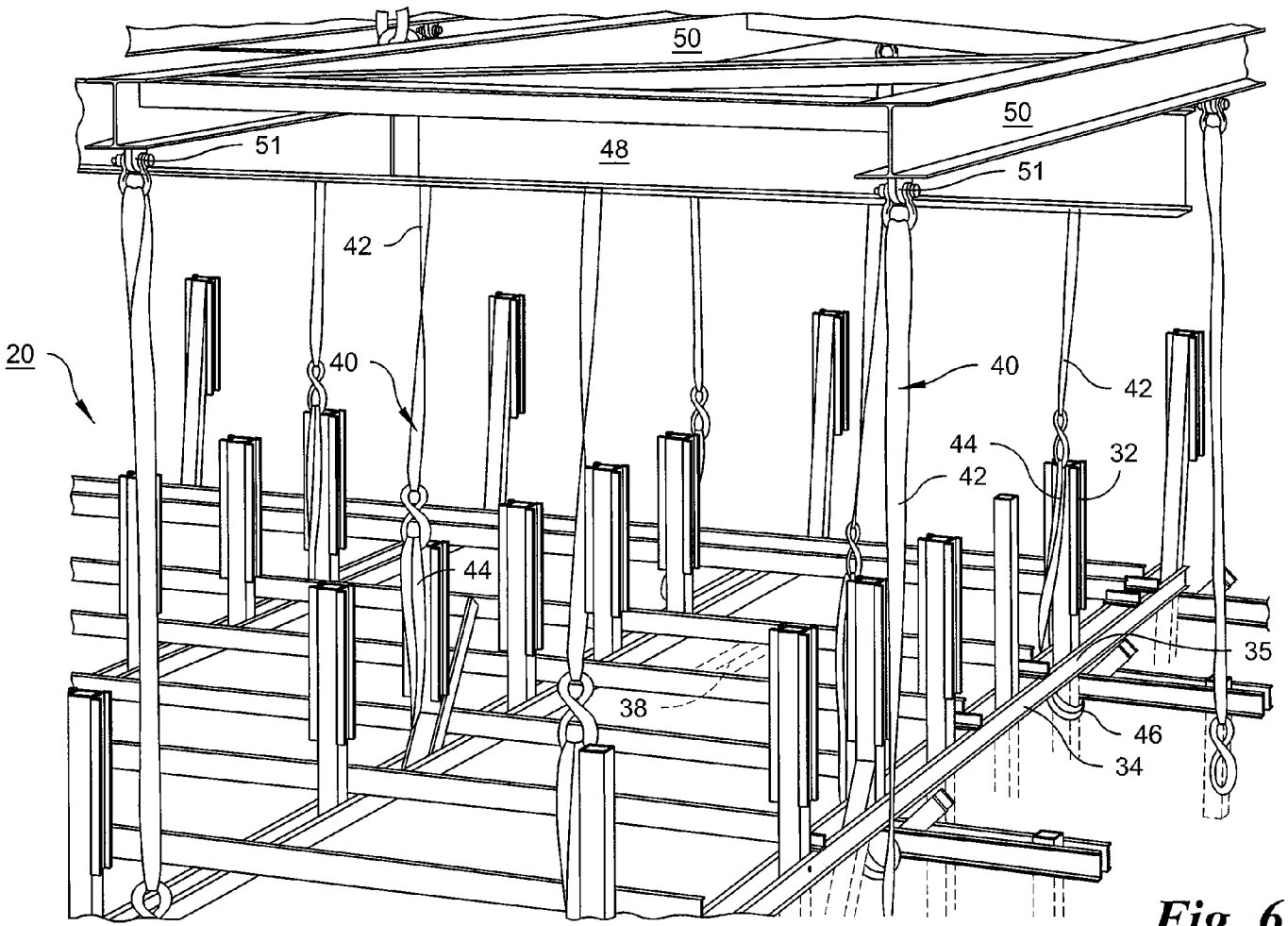
FIG. 6 is an enlarged isometric view of a portion of the lift platform and its connection to the top portion of the cooling tower as it is about to be lifted from the first location and moved to a second location.
Figure 8:
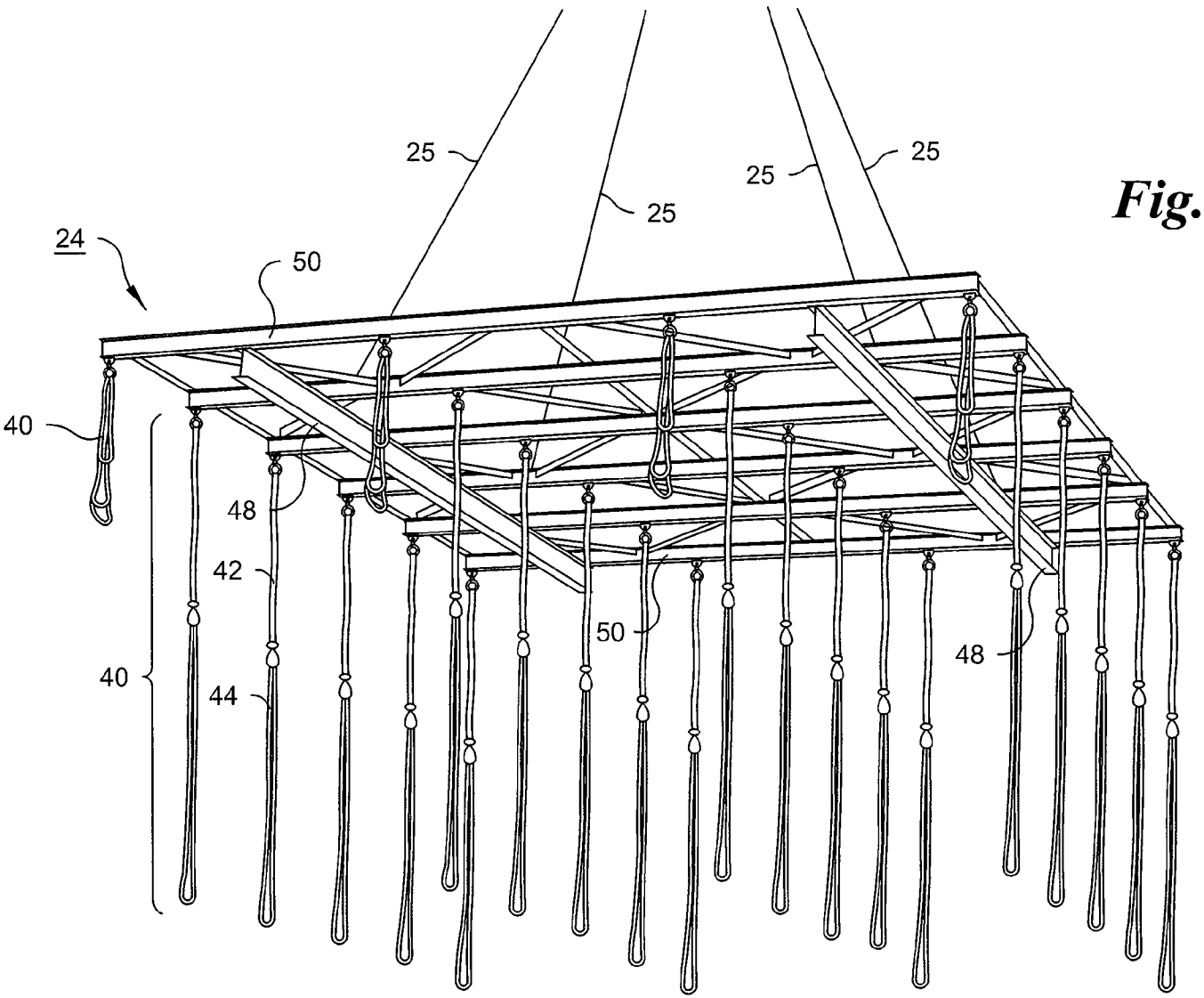
FIG. 8 is a right, front lower isometric view of one embodiment of a lift platform according to the present invention, supported from above and having flexible lift members in the form of straps connected thereto.

Preferably, a lift platform, such as the lift platform 24 mentioned above (one preferred embodiment being described in more detail below), is used in the method of the present invention, but other lift platforms or devices that can support the framework 28 or other components of a structure below the lift platform or other lifting device in a balanced manner to lift and move the structure may be used. FIGS. 6, 7 and 8 show the lift platform 24 being moved to be positioned over a structure, such as the top portion 22 of a cooling tower in FIGS. 6 and 7, where FIG. 8 just shows the lift platform 24 being positioned over a structure (not shown) that is to be lifted and moved. The structure to be lifted and moved is connected to the lift platform by a plurality of flexible but strong lift members 40 evenly spaced lengthwise and widthwise along beams of the lift platform to distribute as reasonably evenly as possible the weight of and to support and balance the structure, such as the bottom portion 20 or the top portion 22 of the cooling tower, to be lifted. The flexible lift members 40 connecting the lift platform 24 to the structure, such as the cooling tower bottom portion 20 or the top portion 22, may be any number of commercially available straps made of material such as nylon, polyester, Kevlar or the like, as well as ropes or cables made of any suitable, commercially available material. Relatively wide straps, rather than ropes or cables, are preferred as the flexible lift members 40, since they are less likely to damage the framework 28 of the structures used to make many structures, such as field-erected cooling towers, and are easy to adjust, attach to and detach from the framework 28.

One presently preferred embodiment of the many flexible lift members 40 and their connection to the lift platform 24 and the cooling tower top portion 22 will be described with reference to FIGS. 6 and 8. Other techniques could be used, depending on the nature and makeup of the framework 28 and the structure to be lifted and moved. The preferred embodiment of a flexible lift member 40 is a two component set of straps 42 and 44. For each flexible lift member 40, an upper strap 42 is attached at its upper end to a support structure, such as a U-shaped retainer (pin shackle), held by a pin in a structure lift lug 51 secured, preferably by welding or by other type of fastening, such as bolts and nuts, to a lift beam 50, best seen in FIG. 6. There are several lift beams 50, supported by at least two carrier beams 48 of the lift platform 24 to be described in more detail below. The upper strap 42 is connected at its lower end, for example by a properly sized and rated, closable safety hook, to a lower strap 44, which preferably is in the form of a closed loop strap.

The connection of the lift platform 24 to the cooling tower top portion 22 by flexible lift members 40 will be described primarily in connection with FIG. 6, where the cooling tower top portion 22 has been at least partly constructed in a first location. There it can be seen that the preferred embodiment of the flexible lift member 40 comprises the upper strap 42 and the lower, closed loop strap 44 as mentioned above. With reference to the right-hand portion of FIG. 6, the upper strap is connected to the structure by a retainer, such as a shackle, to the structure lift lug 51. The lower end of the upper strap preferably ends with a closeable hook. The lower, looped strap 44 preferably is folded in half to form two looped ends of the strap 44. The first of such ends of the looped strap is held within the closeable hook. The second, loose looped end of the lower looped strap 44 then is directed under a horizontal member 34 of the framework at an intersection 35 of the horizontal member 34 with the vertical member 32 of the framework 28. The second, loose end of the lower looped strap is then moved to form a loop 46 extending around the vertical member 32 and upwardly until that second looped end is retained in the same closable hook holding the first end of the lower looped strap 44. In this manner, the flexible lift member 40 is securely fastened to both the lift platform 24 and to the framework 28 of the cooling tower top portion 22 below the lift platform 24.

Once the lift platform is connected at its upper portion to a lifting device by the cables 25 and at its lower portion to the cooling tower top portion 22, the lifting device lifts the entire structure 22 as shown in FIGS. 1 and 2. The cooling tower 22 is balanced and well-supported by the lift platform 24 and below the lift platform 24 as shown in FIGS. 1 and 2. Thereafter the lifting device moves the lift platform 24 carrying the cooling tower top portion 22 to the second, adjacent location, where it is positioned over the cooling tower bottom portion 20, as best seen in FIG. 7. Then, the top portion 22 is lowered, connected to the bottom portion 20 and the construction of the cooling tower as a structure is finished at the second location by connecting the internal components and any external components, such as various cooling water pipes, installation of the balance of heat transfer media and drift eliminators, the process fluid pipes, electrical connections, any appropriate number of fans and motors, etc., so that the cooling tower is fully functional and operable.

The whole method of construction of the present invention takes a considerably shorter time than in prior methods of installation where the old tower had to be dismantled and discarded, the site prepared and then the tower constructed just at the second location by constructing the framework on a member by member basis (the so-called "stick" method, or by moving bents compiled at a first location into the second location and erecting the framework in the second location using the bents individually moved from the first location. The method of the present invention productively uses the time involved in dismantling and removing any old equipment and preparing the site at the second location, since the construction work on the replacement tower is already ongoing at the first location while the site is being readied at the second location.

As noted above, while any platform or other device could be used to lift and move the structure, it is preferred to use a lift platform to distribute the weight evenly to make the lifting and moving more balanced, secure and easier. As a result, another aspect of the present invention is a suitable lift platform having these characteristics. As with the embodiment of the method described above with respect to a heat exchange apparatus in the form of a cooling tower as one example of a structure that may be lifted and moved from the first location to the second location, for the sake of convenience and consistency, the preferred embodiment of the lift platform 24 of the present invention will be described as one useful in the present method, for lifting, balancing and moving the heat exchange apparatus, by way of example, a cooling tower, such as either the top portion 22 or the bottom portion 20, or both portions. Nevertheless, the lift platform 24 of the present invention may be used to lift, and preferably to move, any structure suspended below the lift platform 24 where it is important to maintain the balance and integrity of the structure while the structure is being lifted and moved. The lift platform must have sufficient strength and stiffness to be capable of being connected by flexible lift members to the structure below the lift platform to be lifted.

An effective lift platform 24 is shown best in FIGS. 8-17. With reference to the right, front lower isometric view of FIG. 8 and the top plan view of FIG. 9, where the front of the described embodiment of the lift platform is oriented at the bottom of the sheet of FIG. 9, the lift platform 24 comprises at least two transversely spaced longitudinal carrier beams 48, each preferably in the form of an I-beam having an I-shaped cross-section transverse to a longitudinal direction along the beam. The carrier beams 48 are preferably made of steel and are of such a size and composition to safely support the weight of the remainder of the lift platform and any structure supported by the lift platform. Other strong, relatively stiff material besides steel could be used, such as titanium, for example, which would reduce the weight, but very significantly increase the cost of the lift platform, so at the present time, steel is the preferred, but by no means the exclusive material to be used for the carrier beams 48 and the other beams and braces of the lift platform. While only two carrier beams 48 are shown in the drawings, to lift larger structures that have a bigger plan area, more carrier beams may be used as necessary.

Figure 9:
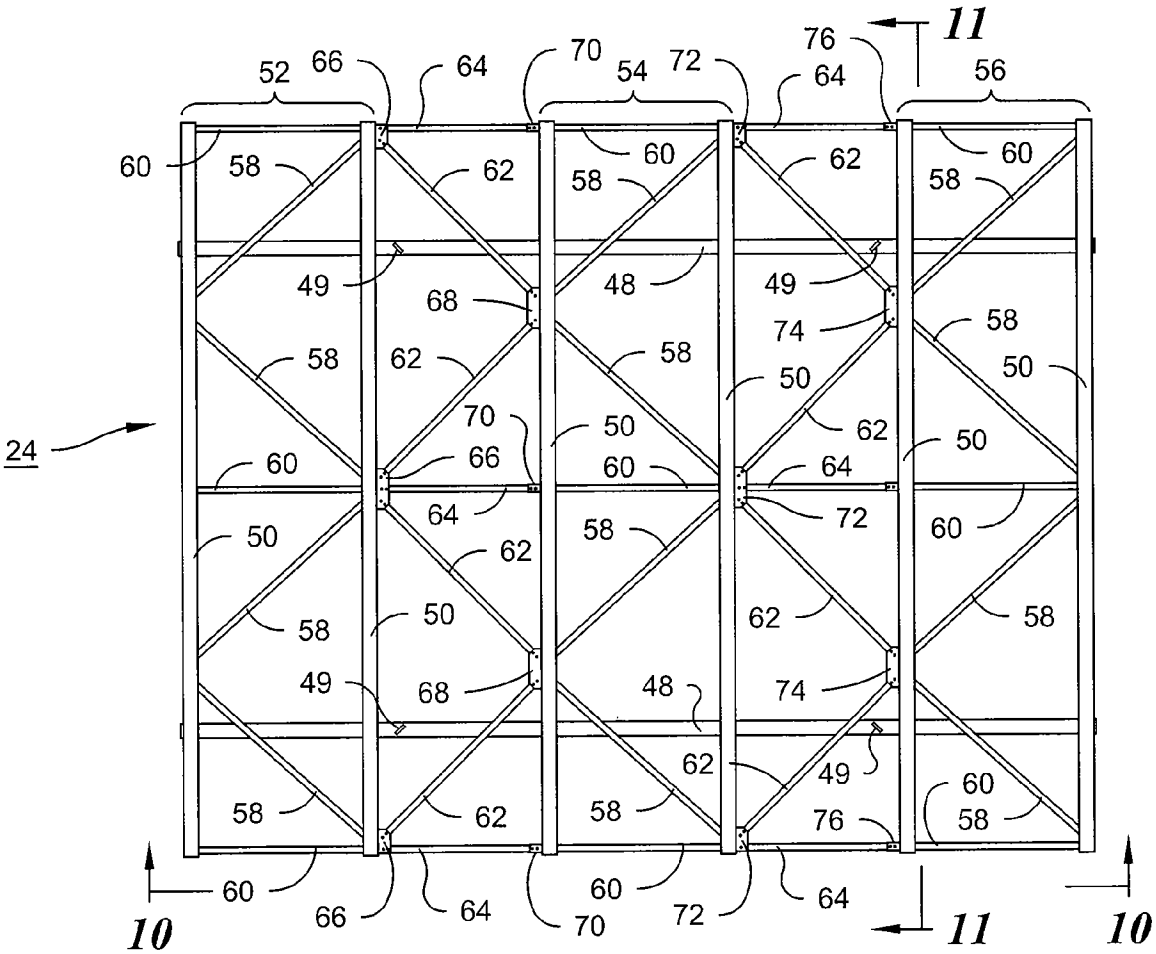
FIG. 9 is a top plan view of the lift platform of FIG. 8.

Appropriately spaced, preferably welded to the top surface of the carrier beams 48 are at least a pair of platform lift lugs 49 spaced to evenly balance the load and adapted to be connected to lifting cables of a hoist device, such as cables 25 shown in FIG. 8. In one embodiment as shown in FIG. 9, where the carrier beams 48 are 30 feet (9.14 meters) long, the platform lift lugs 49 are preferably spaced 7 feet (2.13 meters) from the ends of the beams 48. The platform lift lugs are preferably made of steel and of such dimensions to be able to safely support the weight of the lift platform itself and any structure, with an appropriate safety factor included being planned to be lifted using it. Preferably, the platform lift lugs 49 are welded to the carrier beams 48, though they could be attached using suitable fasteners, such as bolts and nuts. The platform lift lugs 49 are preferably angled as best seen in FIG. 9 so as to reduce the stress applied to the cables or clevis pins connected to the cables when the cables are lifted by a movable hoist to lift and move the lift platform.

The lift platform 24 also includes a plurality of longitudinally spaced transverse lift beams 50 evenly spaced along the length of and preferably generally perpendicular to and supported by the carrier beams 48. Preferably, the transverse lift beams 50 are I-beams having an I-shaped vertical cross-section. They may be and preferably are made of the same material as the longitudinal carrier beams 48. As shown in the embodiment of the lift platform 24 illustrated in FIGS. 9-11, the transverse lift beams 50 are longitudinally spaced 6 feet (1.83 meters) on center from each other along the longitudinal carrier beams 48 when the carrier beams are 30 feet (9.14 meters) long. The spacing of the transverse lift beams 50 may be adjusted to align properly with the structure being lifted. The lift beams 50 are carried on the upper surface of the carrier beams 48 and are securely connected to the carrier beams by four bolts and nuts at teach intersection of the longitudinal carrier beams 48 and the transverse lift beams 50. If desired, although not as secure, the transverse lift beams 50 may be secured below the carrier beams 48, such as to the lower surface of the carrier beams, by welding, nuts and bolt fasteners, or the like.

Figure 10:
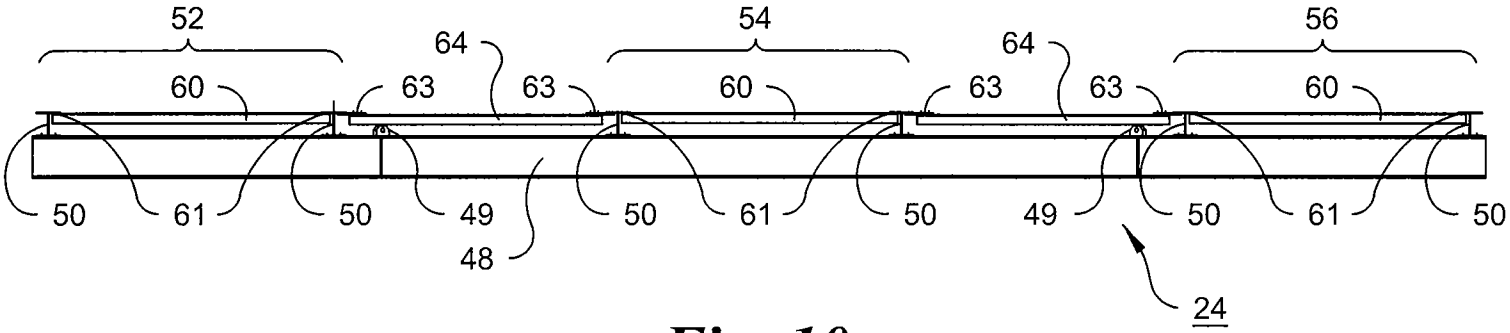
FIG. 10 is a front elevation view of the lift platform taken along lines 10-10 of FIG. 9.
Figure 11:
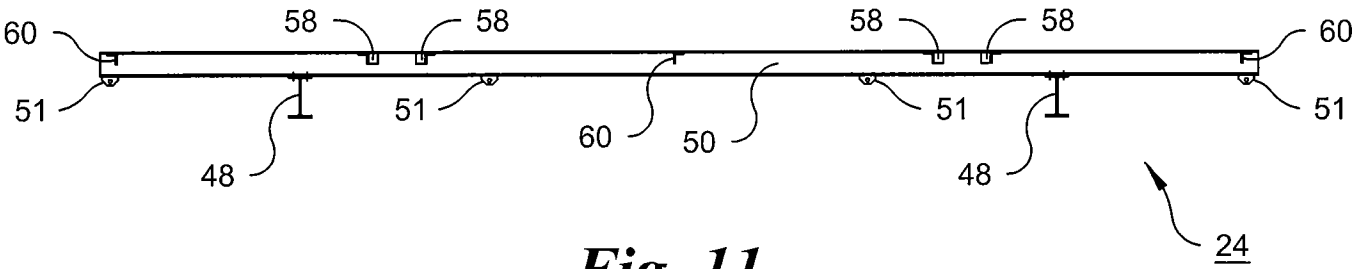
FIG. 11 is a vertical cross-sectional view of a portion of the lift platform taken along lines 11-11 of FIG. 9.

Spaced evenly along the length of and on the underside of each of the lift beams 50, as best seen in the cross-sectional view of FIG. 11, are a plurality of structure lift lugs 51 that are preferably welded to the lift beams 50, but they may be secured by bolts and nuts if desired. For the embodiment of the lift platform 24 shown in FIGS. 9-11, where the lift beams are 24 feet, 5 inches (7.44 meters) in length, four structure lift lugs 51 are spaced 8 feet (2.44 meters) apart and start 2.5 inches (6.35 centimeters) from the end of the transverse lift beams 50. Thus, in the illustrated embodiment, where there are six transverse lift beams 50 used in the lift platform, there are 20 structure lift lugs 51. The structure lift lugs 51 are adapted to hold U-shaped shackles retained by pins to the structure lift lugs 51 as best seen in FIG. 6, where the shackles are adapted to connect to the upper end of the flexible lift members 40 as shown in FIG. 6 and in FIG. 8. The dimensions and distances set forth herein for the embodiment of the lift platform 24 illustrated and described are merely exemplary and without limitation, and other dimensions and distances could be used so long as the resulting lift platform has the structural strength and rigidity and provides for the appropriate balance and lift capacity for the particular structure being lifted and moved.

A number of braces assure the structural rigidity, stiffness and strength of the lift platform 24, as best seen in FIG. 9. The braces may be and preferably are diagonal braces 58 and 62 and perpendicular braces 60 and 64 connecting pairs of the transverse lift beams 50. The braces are preferably angled steel having an L-shaped cross-section transverse to a longitudinal direction along the brace and may be welded to the transverse lift beams 50 or secured by bolts and nuts to the lift beams 50.

Figure 12:
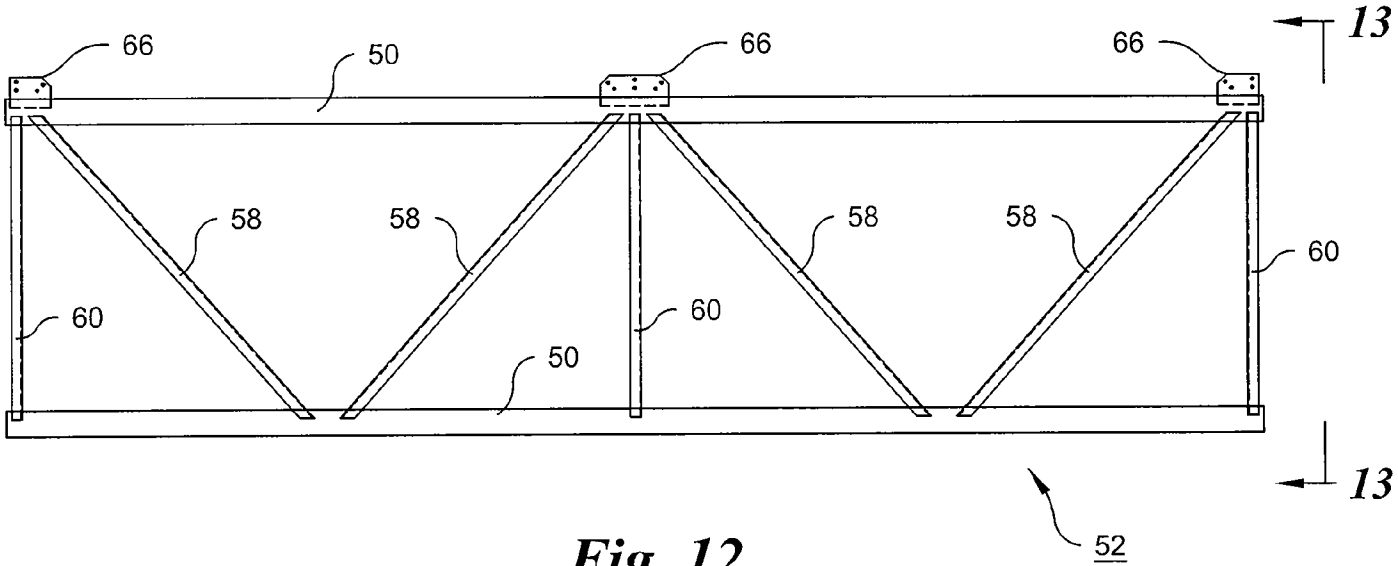
FIG. 12 is a top plan view of a first subassembly unit used to make the first embodiment of the platform shown in FIG. 9, where the subassembly of FIG. 12 is shown in the left-hand side of FIG. 9.
Figure 13:
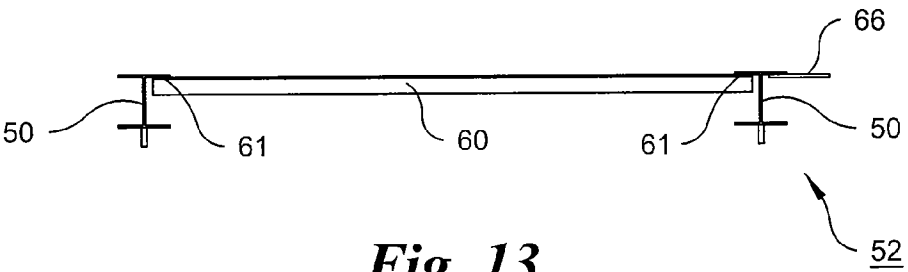
FIG. 13 is a front elevation view of the subassembly unit of FIG. 12 taken along lines 13-13 of FIG. 12.
Figure 14:
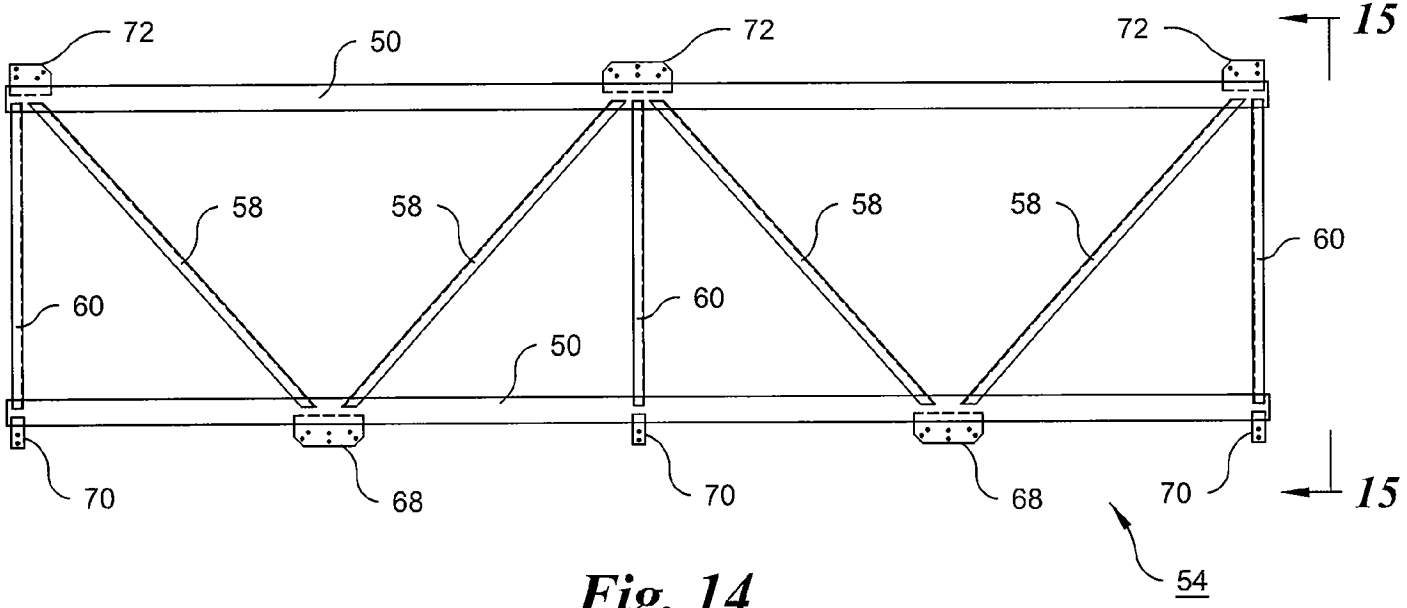
FIG. 14 is a top plan view of a second subassembly unit used to make the first embodiment of the platform shown in FIG. 9, where the subassembly unit of FIG. 12 is shown in the middle of FIG. 9.
Figure 15:
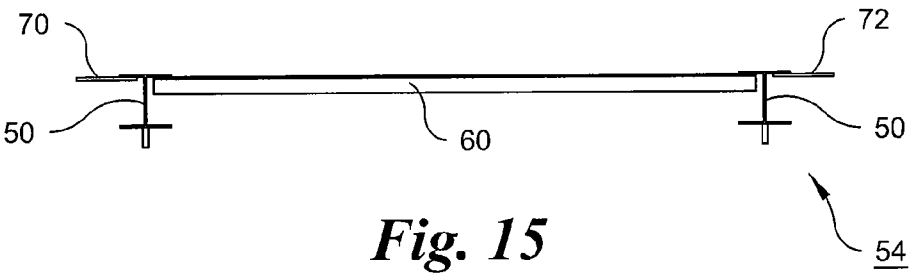
FIG. 15 is a front elevation view of the subassembly unit of FIG. 14 taken along lines 15-15 of FIG. 14.
Figure 16:
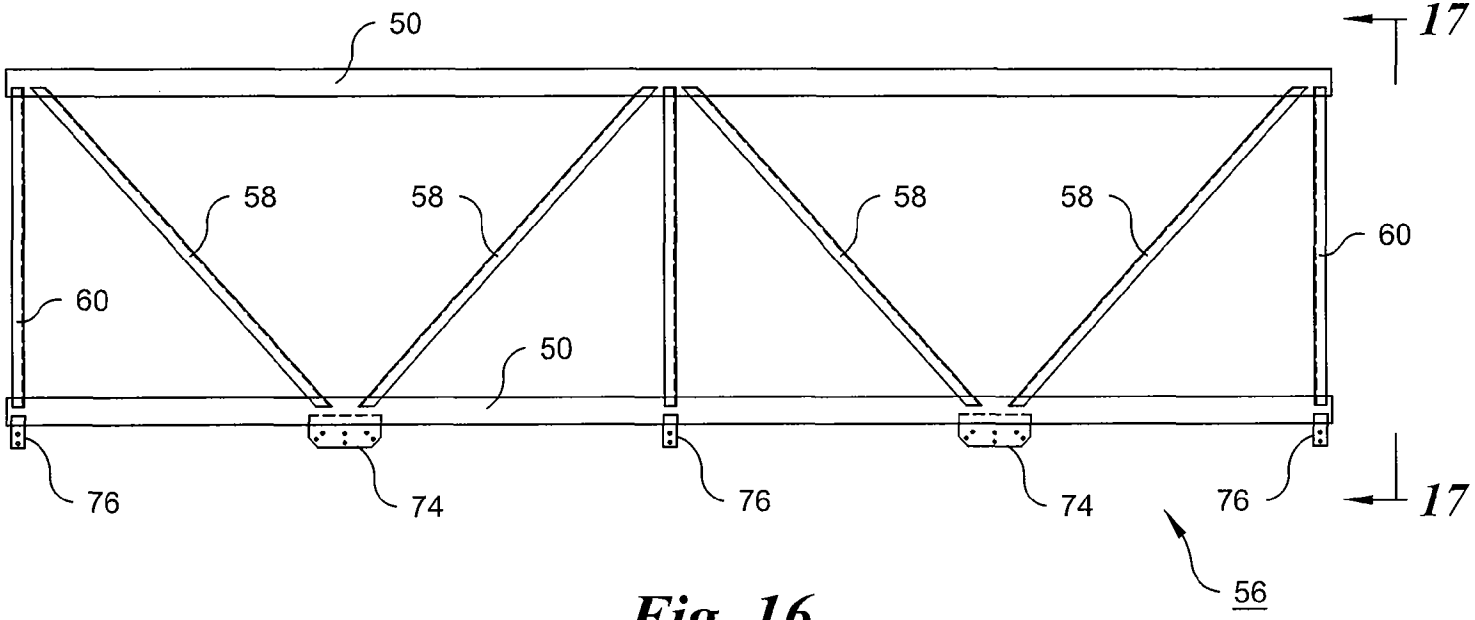
FIG. 16 is a top plan view of a third subassembly unit used to make the first embodiment of the platform shown in FIG. 9, where the subassembly unit of FIG. 16 is shown in the right-hand side of FIG. 9.
Figure 17:
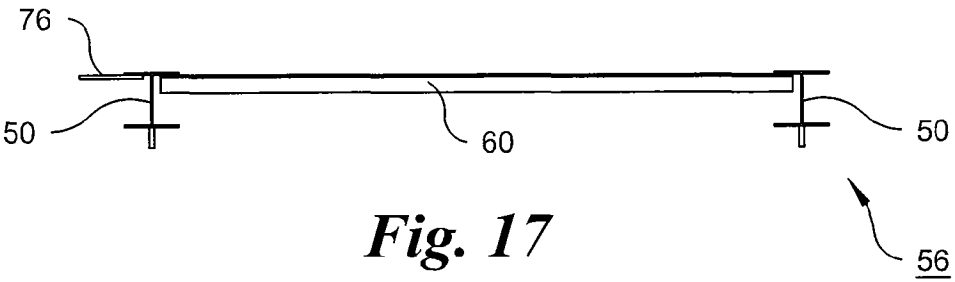
FIG. 17 is a front elevation view of the subassembly unit of FIG. 16 taken along lines 17-17 of FIG. 16.

To make the lift platform 24 easier to transport to a job site and to speed the construction of the lift platform 24 at the job site, typically at the first location described above regarding the construction method, the transverse lift beams 50 may be provided as subassembly units of two transverse lift beams 50 with integrated pre-welded bracing in the form of first diagonal braces and first perpendicular braces connecting the lift beams 50 forming the subassembly unit. Welding is preferred, as it aids in enhancing structural stability of the subassembly units, and thereby of the lift platform. The number of subassembly units used in any given lift platform depends on the length of the carrier beams 48 and the spacing of the transverse lift beams 50. In the lift platform embodiment shown in FIGS. 9-11, there are three subassembly units. Thus, from the left-hand side of FIGS. 9 and 10, there are a first subassembly unit 52, a second subassembly unit 54 and a third subassembly unit 56. The subassembly units are then interconnected using second diagonal braces and second perpendicular braces, connected by bolts and nuts between the first subassembly unit 52 and the second subassembly unit 54 on the one hand, and between the second subassembly unit 54 and the third subassembly unit 56, on the other hand. The subassembly units will be described in more detail below with respect to FIGS. 9-17, where FIGS. 12 and 13 show the details relating to the first subassembly unit 52, FIGS. 14-15 show the details relating to the second subassembly unit 54, and FIGS. 16-17 show the details relating to the third subassembly unit 56. Other connection points and dimensions for all of the components, as well as the number and arrangement of the components, could be used for the subassembly units 52, 54 and 56, as appropriate for the weight and size of the structure to be lifted.

With reference to FIGS. 9-13, the first subassembly unit 52 comprises a pair of transverse lift beams 50 connected by oppositely angled first diagonal braces 58 and first perpendicular braces 60. The first braces 58 and 60 preferably are welded at their opposite ends at weld areas 61 (FIG. 10) to the undersurface of the top flange of each of the I-beams forming the transverse lift beams 50 within the subassembly unit 52. With reference to FIGS. 12 and 13, three bolt plates 66 are welded to the undersurface of the top flange of the I-beam 50 of the first subassembly unit 52 that is to be located adjacent to the second subassembly unit 54.

With reference to FIGS. 9-11, 14 and 15, the second subassembly unit 54, which is the middle of the three subassembly units, comprises a pair of transverse lift beams 50 connected by oppositely angled first diagonal braces 58 and first generally perpendicular braces 60. The first braces 58 and 60 preferably are welded at their opposite ends at weld areas 61 (FIG. 10) to the undersurface of the top flange of each of the I-beams forming the transverse lift beams 50 within the subassembly unit 52. With reference to FIGS. 14 and 15, two bolt plates 68 and three bolt plates 70 are welded to the undersurface of the top flange of the I-beam 50 of the second subassembly unit 54 that is to be located adjacent to the first subassembly unit 52. Also, with reference to FIGS. 14 and 15, three bolt plates 72 are welded to the undersurface of the top flange of the I-beam 50 of the second subassembly unit 54 that is to be located adjacent to the third subassembly unit 52.

With reference to FIGS. 9-11, 16 and 17, the third subassembly unit 56 comprises a pair of transverse lift beams 50 connected by oppositely angled first diagonal braces 58 and first generally perpendicular braces 60. The first braces 58 and 60 preferably are welded at their opposite ends at weld areas 61 (FIG. 10) to the undersurface of the top flange of each of the I-beams forming the transverse lift beams 50 within the third subassembly unit 56. With reference to FIGS. 16 and 17, two bolt plates 74 and three bolt plates 76 are welded to the undersurface of the top flange of the I-beam 50 of the third subassembly unit 56 that is to be located adjacent to the second subassembly unit 54.

As explained above, each of the transverse lift beams 50 is bolted to the longitudinal carrier beams 48 at each of their intersections. However, this does not provide a sufficiently rigid lift platform 24. This is why the first oppositely diagonal braces 58 and the first perpendicular braces are used to enhance rigidity within each subassembly unit. The rigidity is further enhanced by connecting the second subassembly unit 54 to each of the first subassembly unit 52 and to the third subassembly unit 56 using second oppositely angled diagonal braces 62 and second perpendicular braces 64 that are bolted to the respective available and facing bolt plates to form bolted areas 63 as shown in FIG. 10.

The interconnected subassembly units 52, 54 and 56 provide a rigid, stiff and strong lift platform 24 that is capable of being supported by a hoist device and is capable of supporting and balancing below the lift platform 24 a cooling tower bottom portion 20, a cooling tower top portion 22 or any other large structure during lifting and moving of the structure.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A method for constructing a field-erected heat exchange apparatus, wherein the heat exchange apparatus is to be lifted and moved from a first location to a second location, the method comprising:

(a) constructing, at the first location, a framework of the structure, the framework including braces as necessary to withstand lifting and moving the heat exchange apparatus;

(b) constructing, at the first location, at least some internal components of the heat exchange apparatus necessary for operation of the heat exchange apparatus other than connection components that are necessary to connect components of the heat exchange apparatus to other components external to the heat exchange apparatus within the framework;

(c) providing a lift platform comprising interconnected longitudinal carrier beams and transverse lift beams, the transverse lift beams being securely connected to and supported on top of the longitudinal carrier beams, wherein the lift platform is capable of supporting, balancing and lifting the framework below the lift platform by flexible lift members to be attached to the lift platform and the framework;

(d) attaching the flexible lift members at a top end only to the transverse lift beams of the lift platform and at a bottom end to a plurality of spaced portions of the framework to balance the heat exchange apparatus below the lift platform and attaching a plurality of spaced cables only to the longitudinal carrier beams for lifting the lift platform;

(e) lifting the lift platform by the plurality of spaced cables to thereby lift the lift platform and the heat exchange apparatus; and (f) while lifted, moving the lift platform and the heat exchange apparatus to the second location.

2. The method of claim 1, wherein (a) further comprises constructing at the first location framework subassemblies comprising interconnected horizontal and vertical members, and bracing as needed, then lifting the subassemblies and connecting the subassemblies together with additional bracing as necessary to form the framework of the heat exchange apparatus.

3. The method of claim 2, wherein the flexible lift members at their bottom end loop around some of the vertical members and loop under horizontal members intersecting the vertical members, and wherein the flexible lift members are connected at their top end by a closable hook directly or indirectly to the transverse lift beams of the lift platform.

4. The method of claim 1, further comprising:

(g) completing, at the second location, construction of the heat exchange apparatus by installing exterior panels and by connecting the internal components of the heat exchange apparatus necessary for operation to other components external to the heat exchange apparatus.

5. The method of claim 1, further comprising:

(g) completing, at the second location, construction of the heat exchange apparatus.

6. The method of claim 1, wherein the longitudinal carrier beams of the lift platform are connected by the plurality of spaced cables to a ground-based, movable hoist and wherein the hoist lifts and moves the lift platform and the heat exchange apparatus from the first location to the second location.

7. The method of claim 6, wherein the lift platform is connected by the plurality of spaced cables to a single ground-based, movable hoist.

8. The method of claim 1, wherein the longitudinal carrier beams of the lift platform are connected by the plurality of spaced cables to a helicopter, and the helicopter lifts and moves the lift platform and the heat exchange apparatus from the first location to the second location.

* * * * *